United States Patent [19]

Daussan et al.

[11] Patent Number: 4,909,421

[45] Date of Patent: Mar. 20, 1990

[54] INSTALLATION FOR TEEMING LIQUID METAL AND PROCESS FOR ITS USE

[75] Inventors: Jean C. Daussan, Metz; Gerard Daussan; Andre P. Daussan, both of Longeville-les-Metz, all of France

[73] Assignee: Daussan et Compagnie, Woippy, France

[21] Appl. No.: 276,505

[22] PCT Filed: Feb. 19, 1988

[86] PCT No.: PCT/FR88/00095

§ 371 Date: Oct. 20, 1988

§ 102(e) Date: Oct. 20, 1988

[87] PCT Pub. No.: WO88/06068

PCT Pub. Date: Aug. 25, 1988

[30] Foreign Application Priority Data

Feb. 20, 1987 [FR] France ..... 8702225

[51] Int. Cl.[4] ..... B72D 11/10

[52] U.S. Cl. ..... 222/590; 222/594; 222/602

[58] Field of Search ..... 222/590, 591, 594, 602, 222/606, 600

[56] References Cited

U.S. PATENT DOCUMENTS

| | | | |
|---|---|---|---|
| 3,200,457 | 8/1965 | Wagstaff et al. | 222/602 |
| 4,508,247 | 4/1985 | Mills et al. | 222/602 |
| 4,667,858 | 5/1987 | Nishio et al. | 222/591 |
| 4,791,978 | 12/1988 | Fishler | 222/602 |

FOREIGN PATENT DOCUMENTS

| | | |
|---|---|---|
| 0084416 | 7/1982 | European Pat. Off. . |
| 2008177 | 1/1970 | France . |
| 60-82256 | 5/1985 | Japan . |

*Primary Examiner*—S. Kastler

*Attorney, Agent, or Firm*—Young & Thompson

[57] ABSTRACT

A metallurgical receptacle (1) for a liquid metal (2), provided with a casting orifice (6) and comprising under this orifice (6) a principal device (8) for closing and opening the orifice (6). An auxiliary device (12) for preheating, closing and unplugging the casting orifice (6), is disposed above the orifice (6), and comprises an elongated element (13), adapted to be partially immersed in the liquid metal (2), and formed of a refractory and/or insulating refractory material (34) sinterable in contact with the liquid metal (2). Structure (14, 15, 17, 18, 21) maintains the elongated element (13) on the casting orifice (6) so as to close it before and during the beginning of casting of the liquid metal (2) in the receptacle (1) and to raise this element (13) above the casting orifice (6), this element (13) comprising at least one longitudinal conduit (23) opening opposite or in the proximity of the casting orifice (6) and which is connected to at least one source of gas (30) under pressure permitting the preheating and/or the unplugging of the orifice (6). Used particularly for preheating and/or unplugging a casting orifice (6) of a metallurgical receptacle (1).

10 Claims, 2 Drawing Sheets

INSTALLATION FOR TEEMING LIQUID METAL AND PROCESS FOR ITS USE

The present invention relates to an installation for casting liquid metal comprising a metallurgical receptacle adapted to contain liquid metal, provided with a casting orifice and comprising below this orifice a principal device for closing and opening said orifice.

The invention relates also to the process for using this installation.

It is known that all metallurgical receptacles such as a casting ladle or a tundish for continuous casting, principally for slabs or blooms, comprise a device for closing the casting orifice to permit the closing of this latter before and during the beginning of the casting of the liquid metal in this receptacle, then the opening of this orifice to permit the casting of liquid metal into a second metallurgical receptacle, for example into a continuous casting mold.

Such an apparatus should also permit the partial or total closing of this orifice if it is necessary to limit the flow rate or interrupt the flow of the liquid metal.

The most common closure devices are stopper rods provided with a known refractory cladding requiring heating before the casting of the metal to avoid any risk of solidification of the latter in contact with its surface. The stopper rods are moreover heavy and difficult to manipulate.

Closure devices used at present are sliding nozzles. These are quite satisfactory as to a closing operation before and during casting and at the end of the latter. On the other hand, it can happen that in spite of care taken to prepare the casting receptacle before casting, there will form in the casting orifice a plug of various debris, slag and/or solidified metal preventing the casting of the liquid metal or greatly limiting it.

Such an incident can seriously upset the use of the liquid metal casting room, by retarding the meal casting for the time necessary to clean the obstructed casting orifice, or by prolonging the length of casting as for example in the case of an installation for the continuous casting of liquid metal on several lines, if the casting director decides to avoid use of the obstructed line and use only the other available lines.

If all the lines are obstructed, it can happen that the metal must be cast into holding molds permitting the solidification of ingots which will then be remelted.

Non-opening therefore always generates supplemental costs by loss of production.

The solution consists generally in trying to burn with oxygen the incandescent magma forming the plug which obstructs the casting orifice. To do that, one introduces into this orifice through the lower part of the metallurgical receptacle, a metallic tube through which is supplied a jet of oxygen. It forms on contact with the magma a flame whose heat will melt the latter. This operation is always very delicate. Thus, it frequently happens that in melting the magma the casting orifice and/or the sliding device are damaged. Moreover, this operation is dangerous for the personnel who perform it.

Such a clearing operation is rendered even more delicate when one uses beneath the metallurgical receptacle a casting tube adapted to prevent contact between the liquid metal and the air and the risk of oxidation, while limiting splash. It has been attempted to develop casting tubes provided substantially along their axis with a metallic nozzle by which oxygen can be supplied if the liquid metal does not flow through the casting orifice upon opening the slide device. But cleaning from below the metallic receptacle has never been entirely satisfactory.

Another solution is also proposed in U.S. Pat. No. 4,667,858 to avoid plugging the casting orifice of a metallic receptacle provided with a closure device of the type of a slide nozzle. This solution consists in placing sand in the casting orifice above the slide. However, when the slide is opened, the sand flows and pollutes the metal in the lower receptacle.

It is also known in the steel art to use stopper rods for metallurgical receptacles constituted by a hollow central metallic tube covered with a refractory protection. These stopper rods are adapted to inject into the liquid steel bath purifying gases with or without added powders so as to purify the steel bath, so as to cool it, purge it, and reduce its flow through the outlet orifice. These gases and these powders also have the purpose of cooling these stopper rods. They are not adapted to achieve the objects of the present invention and have a manner of use contrary to the present invention.

The object of the present invention is to overcome the recited difficulties by providing a simple and efficacious installation for casting metal of the recited type, permitting preheating, closing and unplugging a casting orifice of the metallurgical receptacle, which particularly permits, at low cost, the swift and effective elimination of the plug obstructing the casting orifice.

According to the invention, the installation is characterized in that it comprises also an auxiliary device for preheating, closing and unplugging the casting orifice, disposed above said orifice, and comprising an elongated element adapted to be partially immersed in the liquid metal and of a refractory and/or insulating refractory material which is sinterable when in contact with the liquid metal, means to maintain the elongated element on the casting orifice so as to close it before and during the beginning of casting the liquid metal into the receptacle and to raise this element above the casting orifice, this element comprising at least one longitudinal conduit opening opposite and/or proximity to the casting orifice and which is connected to at least one source of gas under pressure permitting the preheating and/or the unplugging of said orifice.

This device, which serves only as an auxiliary for preheating and/or closing the casting orifice at the beginning of casting, may be simple and hence light and economical. This device by its mere presence over the casting opening before the arrival of the liquid metal, also substantially limits the risk of debris falling into the casting orifice to block it. Moreover, this device, which is placed over the casting orifice then is raised slightly above the latter, makes it possible, if a plug should have formed, to blow directly on this plug from a very short distance, and therefore with great precision, an oxidizing gas such as for example oxygen or any other gas enriched in oxygen, oxidizing and/or reducing, to melt this plug. The fact that the elongated element is preferably of a material adapted to sinter in contact with the liquid metal permits it to maintain its mechanical cohesion all the while it is in the liquid metal.

According to a preferred embodiment of the invention, the insulating refractory material, sinterable in contact with the liquid metal, is comprised by inorganic refractory particles such as silica and/or alumina and/or magnesia, and if desired organic and/or refractory fibers, held together with an organic and/or inorganic binder, adapted to sinter in contact with the liquid metal.

Given that this material has a density and thermal conductivity substantially lower than those of known refractories, this material needs no preheating and poses no danger of solidification of liquid metal in contact with it.

Moreover, this material remains slightly malleable after sintering, which favors good closure of the casting orifice.

Finally, this material is very cheap and easy to use.

According to a preferred embodiment of the invention, the conduit is constituted by at least a metallic tube disposed longitudinally within the elongated element and opening at the end of this element located above the casting orifice, the end of this tube opposite the casting orifice being connected by at least one conduit to a source of oxygen and/or analogous oxidizing gas and/or reducing gas under pressure, of gas for bubbling, to a mechanism for supplying powder, particles or metallic wire.

The presence of a metallic tube disposed longitudinally within the elongated element permits a very simple construction of this element for which the tube serves as a reinforcement. As indicated above, the jet of oxygen or enriched gas flowing from the end of the tube and of the elongated element situated above the casting orifice forms a flame in contact with the liquid metal and attacks at a very short distance and therefore with great precision the magma obstructing the casting orifice without damaging the walls of this orifice nor the sliding or rotating closure elements. It is also possible to ignite the gas leaving the elongated element by means of a torch so as to preheat the outlet orifice or by any other ignition device, such as for example by a system of electrodes.

The material of which the elongated element is preferably made being both refractory and insulating, the thickness of this material about the metallic tube may be reduced and this elongated element may thus be very light compared to a conventional stopper rod.

According to another aspect of the invention, the process for using an installation according to the invention comprises the following steps:

(a) the elongated element of the auxiliary or principal device for preheating, closing and unplugging is placed over the outlet orifice, (b) the filling of the receptacle with liquid metal is begun, (c) when the liquid metal reaches the desired level in the receptacle, the principal closure device is opened, then (d) the elongated element of the auxiliary device is raised slightly above the outlet orifice, (e) if the liquid metal does not flow normally through the casting orifice, oxidizing gas is sent through the conduit of the element to eliminate by melting the plug formed in the casting orifice, (f) as soon as the metal flows normally through the casting orifice, the elongated element is raised completely.

Other characteristics and advantages of the invention will also appear from the following description.

In the accompanying drawings, given by way of nonlimiting example:

Figure 1:
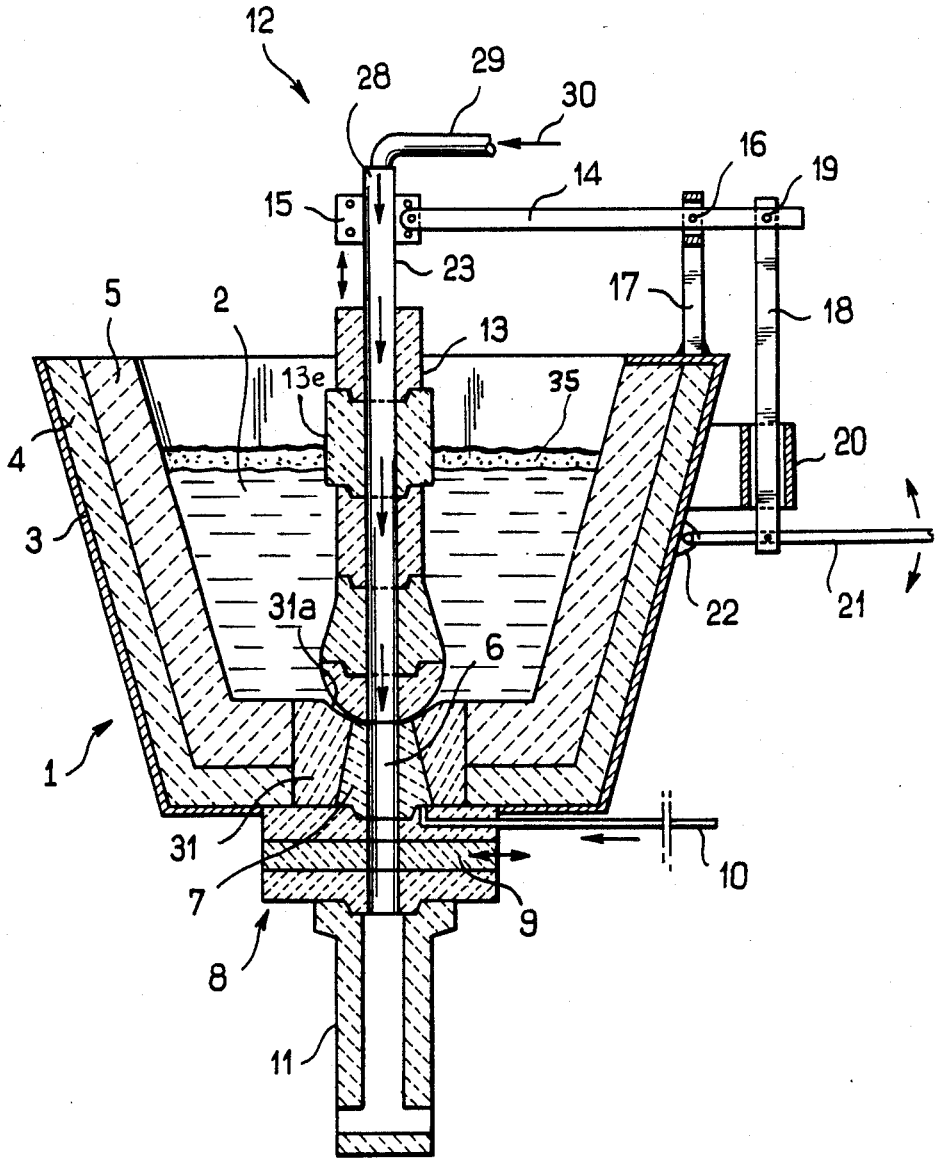
FIG. 1 is a transverse cross-sectional view of an installation according to one embodiment of the invention.

In the embodiment shown in FIG. 1, there is seen at 1 a metallurgical receptacle constituted by a tundish 1 of a continuous casting installation. This tundish 1 containing liquid metal 2 such as molten steel comprises an external steel casing 3, internally clad with a permanent refractory coating 4 which is itself protected preferably by an insulating refractory coating 5.

The casting tundish comprises a casting orifice 6 provided in the casting nozzle 7 ordinarily of refractory material. Below the casting orifice 6 of the tundish 1 is installed a principal closure device 8 with a slide 9. In the illustrated example, the principal closure slide device 8 may comprise tubing 10 permitting the blowing of argon into the nozzle 7 which in this case is of porous refractory material. Below the closure slide device 8 is mounted a casting tube 11.

The casting orifice 6 of the tundish 1 is provided with an auxiliary preheating and/or closure and unplugging device 12, which comprises principally an elongated element 13 disposed substantially vertically above the casting orifice 6 in such a way as to close it.

The element 13 is traversed axially by a metallic tube 23 which serves as reinforcement.

The elongated element may be raised above the casting orifice 6 by any known manual or remote system.

In the illustrated example, this control device comprises a lever 14 articulated at 16 on a support 17 carried by the casing 3 of the tundish The lever 14 is articulated at one end to a collar 15 which grips the upper part of tube 23 above the element 13 and at the other end to a rod 18 guided by a sleeve 20. The rod 18 is moved lengthwise by an operating lever 21 articulated at 22 on the casing 3.

Figure 3:
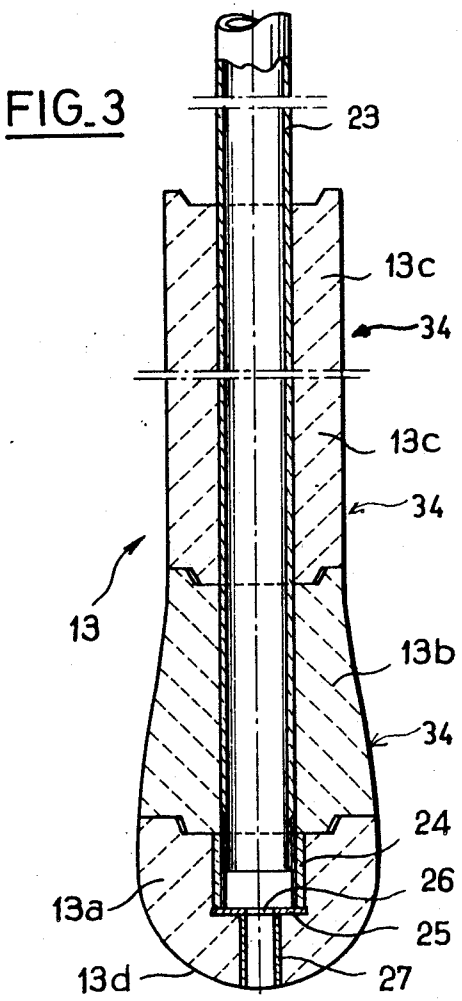
FIG. 3 is an axial cross-sectional longitudinal view of the elongated element of an installation according to the invention.

According to a particularly simple embodiment of the elongated element 13 shown in FIG. 3, this element comprises on its interior the metallic tube 23, ordinarily of plain steel, for example a standard tube of 1" (25.4 mm) nominal diameter. The tube 23 is externally screw threaded at its lower end and screwed into a threaded sleeve 24. The end of sleeve 24 opposite tube 23 is for example welded to a ring 25 provided at its center with a circular orifice 26 in which is welded coaxially with of tube 23 a tubular segment 27 of a diameter less than that of tube 23. At 35, there is shown a layer of insulating material covering the surface of the bath of liquid steel.

In the example shown in FIG. 3, the elongated element 13 is comprised of several annular members 13*a*, 13*b*, 13*c* fitting into each other about the metallic tube 23. These members 13*a*, 13*b*, 13*c* may be secured to each other for example by means of a refractory cement. There can be interposed between the annular members 13*c* one or more members 13*e* of a greater diameter, particularly in the region of the slag and/or the layer of insulating material 35 covering the surface of the liquid steel bath (FIG. 1).

Moreover, the member 13*a* adjacent the casting orifice 6 has a spherical surface 13*d* adapted to be applied in a sealing manner to the truncated conical margin 31*a* of the seating block 31 and on the margin of the nozzle 7 disposed in this latter.

The end 28 of tube 23 opposite the casting orifice 6 is connected to a source 30 of oxygen under pressure by means of a flexible tube 29.

The elongated element 13 can be made in various ways. For example the tube 23 and the sleeve 24 can be assembled, to which have first been secured the ring 25 and the tubular segment 27, to which is added if desired a porous plug permitting the passage of gases, and in a single operation the insulating refractory coating is provided in a press or by accelerated filtration under pressure or by aspiration with the help of a suitable material 34 described below. The material 34 constituting the different members 13*a*, 13*b*, 13*c* of the element 13 is a refractory material and/or a thermally insulating refractory material comprised of inorganic refractory particles, such as silica and/or alumina and/or magnesia . . . and if desired organic and/or refractory fibers, the whole being agglomerated by organic and/or inorganic binders, adapted to sinter in contact with the liquid metal 2.

The composition of the thermally insulating refractory material and the granulometry of these constituents are so adjusted that sintering takes place, in the case of steel metallurgy, between 800° C. and 1500° C. However, the addition of a mineral binder frees the composition from the constraints of sintering. The specific mass of this material may vary between 0.5 and 2.9 kg/dm$^3$ as a function of the composition and of the granulometry of these constituents.

To facilitate production of the elongated element 13 in a single operation, one can preliminarily coat the external walls of the tube 23, of the sleeve 24, of the ring 25 and of the tube segment 27 with a cement facilitating the adherence of the material 34 to the metal.

Another way of producing the element 23 consists in separately preparing that portion of the end 13*a* having substantially the form of a hemisphere elongated by a cylinder, then screwing the tube 23 into the sleeve 24 and then sliding onto the tube 23 the various prefabricated tubular members 13*b*, 13*c*.

The lower member 13*a* adapted to close the casting orifice 6, which supports the hydrostatic pressure of the liquid metal and bears on the periphery of the casting orifice 6 comprises the maximum thickness of refractory and/or insulating refractory material 34. It has for example an external diameter of 132 mm and a total height of 100 mm which comprises the height of the truncated conical recess permitting the interfitting, namely for example 15 mm, and the height of the threaded sleeve 24, namely for example 42 mm, the upper portion of the sleeve being flush with the level of the refractory and/or insulating refractory material.

The upper tubular members 13*b*, 13*c* which are subjected to a lesser effort can have less thickness of material 34 and can have for example an external diameter of about 75 mm for an internal diameter of the order of 35 to 40 mm, and a unit height of 150 mm.

The members 13*a*, 13*b*, 13*c* may be made for example by pressing or by accelerated filtration under pressure or by aspiration. They can be refractory and/or insulating refractory. They can have a larger diameter in the region of the slag than the elements 13*b* and 13*c*.

There will now be described with reference to FIGS. 1, 2 and 3, the process for using the installation according to the invention in the illustrated case in which the receptacle is a continuous casting tundish.

When the distributor 1 comprising an auxiliary device 12 and a principal device 8 is ready for the next casting, a new elongated element 13 is secured to the arm 14. The element 13 rests with its own weight on the bottom of the tundish 1 and care is taken to center the lower spherical member 13*a* on the casting orifice 6. The element 13 being in place, the slide device 8 is closed. Only the presence of element 13 on the casting orifice 6 therefore prevents the introduction of undesirable foreign material into this orifice.

Filling of the liquid metal tundish 1 begins. In contact with the liquid metal, or because of the radiation from the liquid metal, the insulating refractory material 34 about the element 13 begins to sinter. The sintering proceeds toward the interior of the material, in proportion to the increase in temperature at the interior of the members 13*a*, 13*b*, 13*c*.

Thanks to this sintering, the cohesion of the material is maintained, despite the decomposition of the binder. Moreover, it has been determined that the liquid metal does not wet the surface of the material of the element 13, whereby the performance of this element is not impaired by undesirable metal adhesion. The material of the element 13 being insulating, metal does not solidify on its surface. Moreover, the material 34 of the element 13 remains slightly malleable even after sintering, which further improves the conditions of closing of the casting orifice 6.

Figure 2:
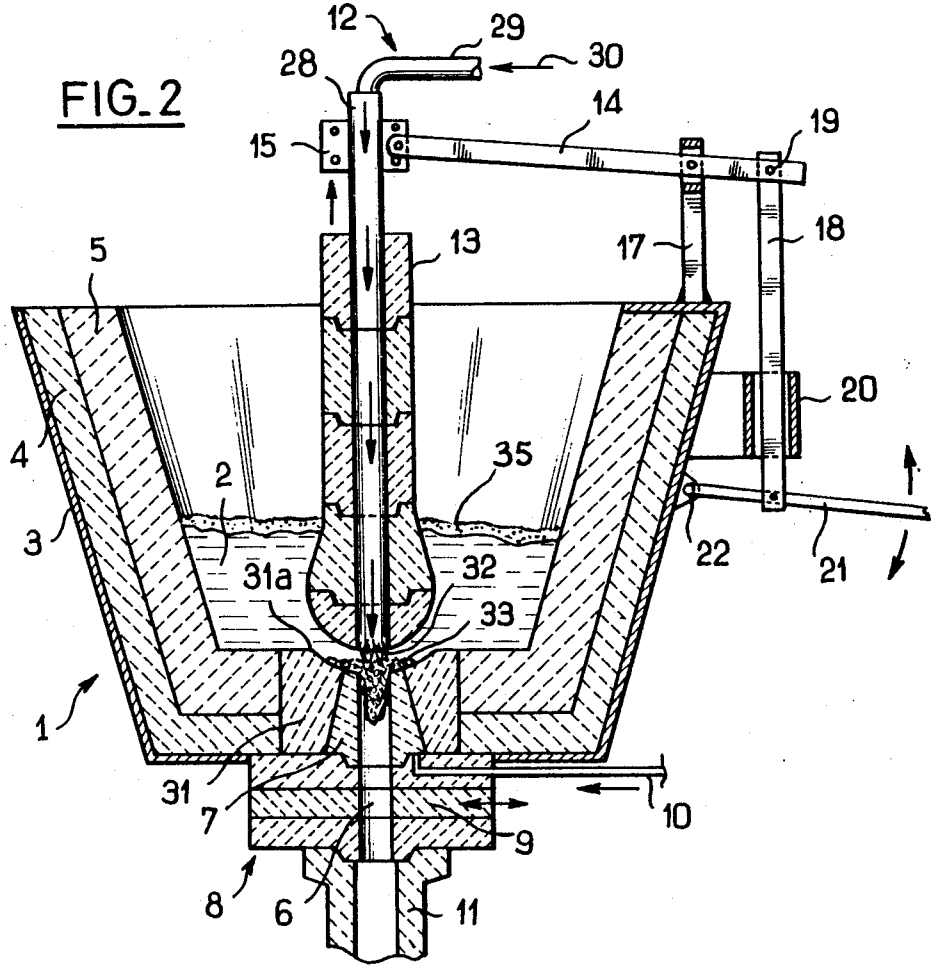
FIG. 2 is a cross-sectional view similar to FIG. 1, the elongated element of the installation according to the invention being raised above the casting orifice, and being different from the one shown in FIG. 1.

Preferably when the liquid metal in the tundish 1 achieves the required level, the surface of the liquid steel bath is covered with an insulating material 35, then the principal slide closure device 8 is opened, then, by means of levers 21 and 14 the element 13 is slightly raised above the casting orifice 6, as shown in FIG. 2. If the metal flows normally, the element 13 can be raised to its upper disengagement position and maintained there by any securement device (not shown).

If the metal does not flow at all or does not flow normally through the casting orifice 6, the element 13 is again lowered onto this orifice 6 and oxygen is blown through the tube 23 and the tube segment 27 which forms nozzle. In contact with the liquid metal, there is immediately formed a flame 32 which melts and causes to disappear any magma 33 of metal and of foreign material obstructing the casting orifice 6.

As soon as the metal flows normally, the element 13 is again raised to its upper disengagement position and maintained there. Then, if argon blowing is provided, the argon inlet can be opened through the conduit 10 into the nozzle 7 to eliminate any impurities from the vicinity of the orifice 6.

When casting is almost over, it is possible to close the casting orifice 6 by means of the elongated element before effecting closure of the slide nozzle 8. If the slide nozzle 8 is directly closed, there is danger of accumulation above the slide 9 in the orifice 6 of a steel magma and/or slag and insulating powder which can solidify in the orifice 6 and render more difficult the replacement of the slide nozzle 8 and that of the nozzle 7. On the other hand, when proceeding as above, the slide nozzle 8 is closed when the orifice 6 is completely free. Casting can thus be interrupted before the passage of slag into the nozzle without risking complication of resetting the installation before the next casting.

At the end of casting, the supply of oxygen or of enriched and/or oxidizing and/or reducing gas is shut off to the tube 23, element 13 is removed and replaced by a new element.

Of course, the invention is not limited to the described example and numerous modifications can be resorted to without departing from the scope of the invention.

For example, the invention is not limited to steel metallurgy and may be used for all liquid metals, particularly aluminum, copper and their alloys, provided that the composition and granulometry of the materials constituting the material of element 13 whose members 13*a* or 13*b* or 13*c* or 13*e* are insulating refractory ones, be adapted to permit sintering of this material in contact with the liquid metal.

This refractory insulating material may if desired be acid, basic or neutral as a function of the composition chosen according to the intended use. The total charge of the refractory constituent or constituents of this material may be up to 99.5%, the percentage of fibers in turn being up to 20%, preferably, the insulating refractory members not subjected to sintering contain a mineral binder.

The installation according to the invention may be adapted for example to a casting ladle and/or to each casting orifice of a tundish , the length of the element 13 being adapted to the conditions of use. The slide nozzle may be replaced by a rotating nozzle.

Moreover, the tube 23, the sleeve 24, the ring 25, the tube segment 27 may be replaced by equivalent elements assembled by any known means.

It follows that the device 12 can be used to introduce into the steel bath through the tube 23 any useful gases and treatment materials (bubbling gas, powders, particles, metallic wires, etc.)

We claim:

1. Installation for casting liquid metal, comprising a metallurgical receptacle (1) for liquid metal (2), provided with a casting orifice (6) and comprising below this orifice (6) a principal device (8) for closing and opening said orifice (6), an auxiliary device (12) for preheating, closing and unplugging the casting orifice (6), disposed above said orifice (6), and comprising an elongated element (13), to be partially immersed in the liquid metal (2) and made of a refractory or insulating refractory material (34) sinterable in contact with the liquid metal (2), means (14, 15, 17, 18, 21) to maintain the elongated element (13) on the casting orifice (6) so as to close it before and during the beginning of casting of the liquid metal (2) into the receptacle (1) and to raise this element (13) above the casting orifice (6), this element (13) comprising at least a longitudinal conduit (23) opening opposite or in proximity to the casting orifice (6) and which is connected to at least one source of gas (30) under pressure permitting the preheating or the unplugging of the orifice (6).

2. Installation according to claim 1, wherein the insulating refractory material (34) sinterable in contact with the liquid metal (2) comprises inorganic refractory particles selected from the group consisting of silica, alumina, magnesia and a mixture thereof, held together by a binder.

3. Installation according to claim 1, wherein the conduit or conduits provided in the elongated element (13) are constituted by one or more metallic tubes (23) disposed longitudinally within the elongated element (13) and opening at the end of this element located above and/or in proximity to the casting orifice (6), the extremity or extremities (28) of this or these tubes (23) opposite the casting orifice (6) being connected by one or more conduits (29) to a source of material to pass through the conduit.

4. Installation according to claim 3, wherein the elongated element (13) is comprised by several members (13*a*, 13*b*, 13*c*, 13*e*) interfitting within each other about the metallic tube (23).

5. Installation according to claim 4, wherein the member (13*a*) of the elongated element (13) adjacent the casting orifice (6) comprises a metallic sleeve (24) which is axially connected by screwing to the end of the metallic tube (23).

6. Installation according to claim 1 wherein the end of the elongated element (13) adjacent the casting orifice (6) comprises a metallic tubular element (27) of a diameter less than that of the metallic tube (23) and connected axially to this latter.

7. Installation according to claim 1 wherein the end (13*a*) of the elongated element (13) adjacent the casting orifice (6) has a substantially spherical surface.

8. A process for casting liquid metal from a casting orifice (6) of a receptacle (1) for the liquid metal (2), which casting orifice (6) is adapted to be opened and closed by an elongated element (13) of an auxiliary device (12), characterized in that it comprises the following steps:

(a) the elongated element 913) of the auxiliary device (12) is put in place on the casting orifice (6), (b) the filling of the receptacle (1) with liquid metal (2) is begun, (c) when the liquid metal (2) achieves in the receptacle (1) the desired level, a principal closure device (8) is opened, than (d) the elongated element 913) of the auxiliary device (12) is raised slightly above the casting orifice (6), (e) if the liquid metal (2) does not flow normally through the casting orifice (6), oxidizing and/or reducing gas (30) is fed through a conduit (23) of the element (13) to eliminate by melting a plug (33) formed in the casting orifice (6), (f) as soon as the metal flows normally through the casting orifice (6) the elongated element (13) is raised completely.

9. Process according to claim 8, wherein after step (a) and before step (b), the outlet region (6) of the metallurgical receptacle (1) is preheated.

10. Process according to claim 2, wherein the insulating refractory material (34) sinterable in contact with the liquid (2) comprises also fibers.

* * * * *